United States Patent [19]
Kirschstein et al.
[11] 3,934,439
[45] Jan. 27, 1976

[54] DRAW-BENDING APPARATUS AND METHOD

[75] Inventors: Horst Kirschstein, Wuppertal; Frank Rabenschlag, Solingen; Dieter Lotz, Wuppertal; Gerhard Holland-Cunz, Wuppertal; Hans Blomberg, Wuppertal, all of Germany

[73] Assignee: Gebr. Happich GmbH, Germany

[22] Filed: Apr. 1, 1974

[21] Appl. No.: 456,845

[30] Foreign Application Priority Data

Apr. 7, 1973 Germany ..... 2317540

[52] U.S. Cl. ..... 72/21; 72/305; 72/378
[51] Int. Cl.[2] ..... B21D 11/02
[58] Field of Search ..... 72/295, 298, 302, 303, 72/305, 308, 310, 7, 8, 21, 22, 321, 378

[56] References Cited

UNITED STATES PATENTS

| | | | |
|---|---|---|---|
| 2,569,181 | 9/1951 | Laxo | 72/312 |
| 2,897,871 | 8/1959 | Wells | 72/298 |
| 2,944,582 | 7/1960 | Ahonen | 72/298 |
| 3,187,542 | 6/1965 | Heller | 72/321 |
| 3,575,031 | 4/1971 | Gray | 72/302 |
| 3,662,584 | 5/1972 | Jones | 72/321 |
| 3,757,557 | 9/1973 | Kost | 72/302 |
| 3,786,666 | 1/1974 | York | 72/305 |

*Primary Examiner*—Michael J. Keenan
*Attorney, Agent, or Firm*—Ostrolenk, Faber, Gerb & Soffen

[57] ABSTRACT

Draw-bending apparatus for bending portions of a continuous metallic member have spaced bending tables which are rotatable about their axes and which can be clamped to spaced portions of the member to be bent. The tables are then rotated to draw and bend the members to which they are secured. The tables are operated so that they rotate for the same length of time even though they rotate through different angles. Servo valve control means are provided to ensure a constant bending torque for each table and to control the rate of table rotation according to a pre-selected program.

7 Claims, 3 Drawing Figures

DRAW-BENDING APPARATUS AND METHOD

BACKGROUND OF THE INVENTION

This invention relates to a draw-bending apparatus and process, and more specifically relates to a metal bending apparatus in which two spaced rotatable bending tables, which are rotatable about parallel axes, rotate through different bending angles but rotate for the same length of time.

Draw-bending apparatus is well known and commonly consists of two spaced, rotatable tables which can be clamped to respective portions of a member which is to have bends placed therein adjacent each of the tables. The tables are then arranged to rotate and to move relative to one another, so that a drawing operation and a bending operation take place simultaneously.

Where the draw-bending process need not be accurately controlled, the draw bender can be a fully mechanical device. If the draw bender must draw and bend the work material with some accuracy, the tables commonly have a hydraulically driven mechanism which may be mechanically controlled. Where exceptionally high accuracy is desired, the individual bending tables may be moved by their own respective hydraulic systems.

Draw-bending apparatus is also arranged to operate either over a large bending angle or a small bending angle. The use of one type apparatus designed for a small bending angle cannot be easily used to obtain a large bending angle without very substantial modification of the equipment. Thus, devices in their present form are not easily interchangeable with one another.

In order to limit the angle of rotation of the table of the apparatus, mechanical stops are placed in each table to define the beginning and end of the table rotation and thus define the bend radius to be placed in the workpiece. Stops were necessary since one table may continue to rotate after the other is to stop, as when the bends to be formed by the different tables have different radii. Thus, simple braking action in the operating mechanism is usually insufficient to allow the completion of the bending process with good accuracy and so that the same bending radii are always reproduced by the equipment.

The use of stops is disadvantageous, however, since it reduces the useful life of the apparatus because the bearings which carry the worktables will be stressed at each stroke and at the same point in the stroke by the high inertia parts which are in movement. Note that the braking tables are brought to a stop by stops without any prior braking deceleration. Moreover, and because of the large shock forces involved when the apparatus reaches a stop position, extremely high forces are created in the clamping arrangement between the table and the workpiece and it becomes necessary to clamp the workpiece with greater force than would otherwise be necessary to withstand the reaction forces caused by the stopping impulse forces. The necesssity to clamp the workpiece tighter than would otherwise be necessary leads to excessive and undesirable stress in the clamp area on the workpiece.

The above problems are especially apparent when the rotating tables move through different angles. This is because the tables will move at the same angular velocity so that the table with the smaller angle of rotation completes its bend and reaches its stop position before the table which has to execute a larger angle of rotation.

BRIEF SUMMARY OF THE PRESENT INVENTION

In accordance with the present invention, a novel apparatus and process for draw bending is provided wherein workpieces having different bending radii are bent within the same time period and with a system which creates a highly reproducible bend for a workpiece with a given configuration.

In accordance with the invention, a draw-bending apparatus is provided where spaced bending tables have a novel operating mechanism in which the angular movements of the bending tables are controlled relative to one another so that the rotation of the two bending tables is completed in the same time independently of the bending angle through which the bending tables must move.

It has been found that by moving the tables for the same period of time, so that one table has not completed its bend before the other table, that the bends produced in the workpiece will always be uniform. Moreover, by causing the bends to end at the same time, the bending process is completed without recoil which might be produced when one bend stops before another so that the clamping devices which clamp the workpiece to the tables can be lighter and can exert less pressure on the workpiece, thereby to reduce stresses applied to the workpiece.

In accordance with the invention the draw-bending apparatus of the invention has a bending angle greater than the angle heretofore used and is, for example, operable over an angle of 180°. This makes it possible to bend a given workpiece at its opposite ends to form a symmetrically bent device which can be separated in the middle after bending, by way of example.

DETAILED DESCRIPTION OF THE DRAWINGS

Figure 1:
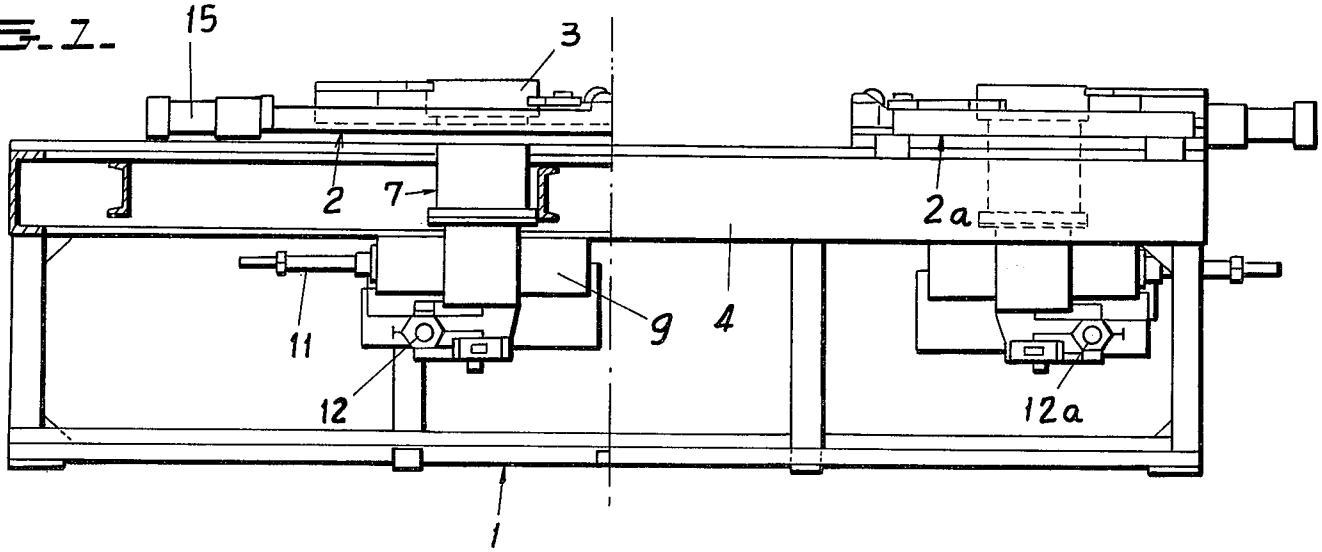
FIG. 1 is a front elevational view of the apparatus of the present invention.

Referring now to FIG. 1, the apparatus is carried on a base 1 which consists of a suitable framework of structural steel elements. Two carriages 2 and 2*a* are mounted on the base 1 and are identical in construction to one another. In the following, the construction of carriage 2 will be described in detail, it being understood that carriage 2*a* will have identical components. A bending table 3 is rotatably carried on the carriage 2 and can receive bending tools which in turn clamp to a member to be bent (not shown) over a given bending angle.

The base 1 will be about table height for convenience of the operating personnel and has guide rails 4 extending longitudinally of the apparatus and which slidably receive carriage 2. The carriage 2 is movable for a limited longitudinal distance over the rails 4. Thus, the carriage 2 contains a plurality of elongated slots 5 which receive corresponding fastening studs, such as the stud 5*a* of FIG. 2, which extend through slots 5 to guide and limit the motion of carriage 2 for the length of the slots 5. The studs, such as stud 5*a*, may also have clamping members so that the carriage 2 can be securely locked in any desired position on the guide rails 4.

Carriage 2 is further provided with a carriage guide 6 which extends longitudinally of the apparatus and which receives the guide ribs of a pedestal 7. The pedestal 7 is a rotatable member and has a rotatable tool holder 8 mounted at its top and which is rotatable about the central axis of pedestal 7 and bending table 3. The tool holder 8 is then rotated by a hydraulic operating mechanism which is driven from hydraulic cylinder 9.

The hydraulic cylinder 9 is of any desired standard type and moves a piston type shaft which extends out of the cylinder 9 and which carries a rack-type gear surface (not shown). The rack member operated by hydraulic cylinder 9 then acts on a pinion gear (not shown) which is rigidly connected to shaft 10 which is fixed to the tool holder 8. Thus, as the hydraulic cylinder 9 is pressurized and depressurized, its rack will move to the right and to the left in FIG. 1, thereby to rotate the pinion gear on shaft 10 in order to rotate the tool holder 8. Clearly, other operating mechanisms for rotating table 3 could be of any other desired type.

The piston member carrying the rack teeth and which is moved by hydraulic cylinder 9 has an outer section which extends into the hydraulic cylinder 11 (FIG. 1). The hydraulic cylinder 11 then operates a servo valve 12, whereby the motion of the piston driven by cylinder 9 is sensed by and monitored by hydraulic cylinder 11 which in turn controls the position of servo valve 12. The servo valve 12 is then further operated to control the pressure applied to the hydraulic cylinder 9 in conjunction with a suitable electronic control and programming system 20 (FIG. 3), thereby to permit exact control of the rotary movement of tool holder 8 so that a uniform angle of rotation is always obtained for a given setting of the electronic system 20.

It should be noted that servo valves, such as the servo valve 12 and its electronic control 20, are standard and well known commercially available components and typically could be a servo valve of the type HDSV Servoventile Zweistufig made by the Herion Company.

The electronic control may now cause the motion of the hydraulic cylinder 9 with constant torque being applied to the tool holder 8 over some given angle of rotation as determined by the position of the hydraulic cylinder 11. This, in turn, causes the servo valve 12 to discontinue the application of operating pressure to the hydraulic cylinder 9 when its final position is reached and to appropriately control the pressure during the rotation of the table 3. Therefore, the use of mechanical stops for the initial and final limitation of the angle of rotation of tool holder 8 can be eliminated and the control of each individual tool holder 8 can be adapted at will to any particular requirement through the suitable electronic control and programming circuitry 20 for the servo valve 12. Thus, the two tool holders 8 of carriages 2 and 2a can be controlled individually, differing in the total angle of rotation and in the speed of rotation while the available torque applied from the tool holders 8 to the workpiece is applied for the same length of time, and can remain constant over the entire bending time.

Figure 3:
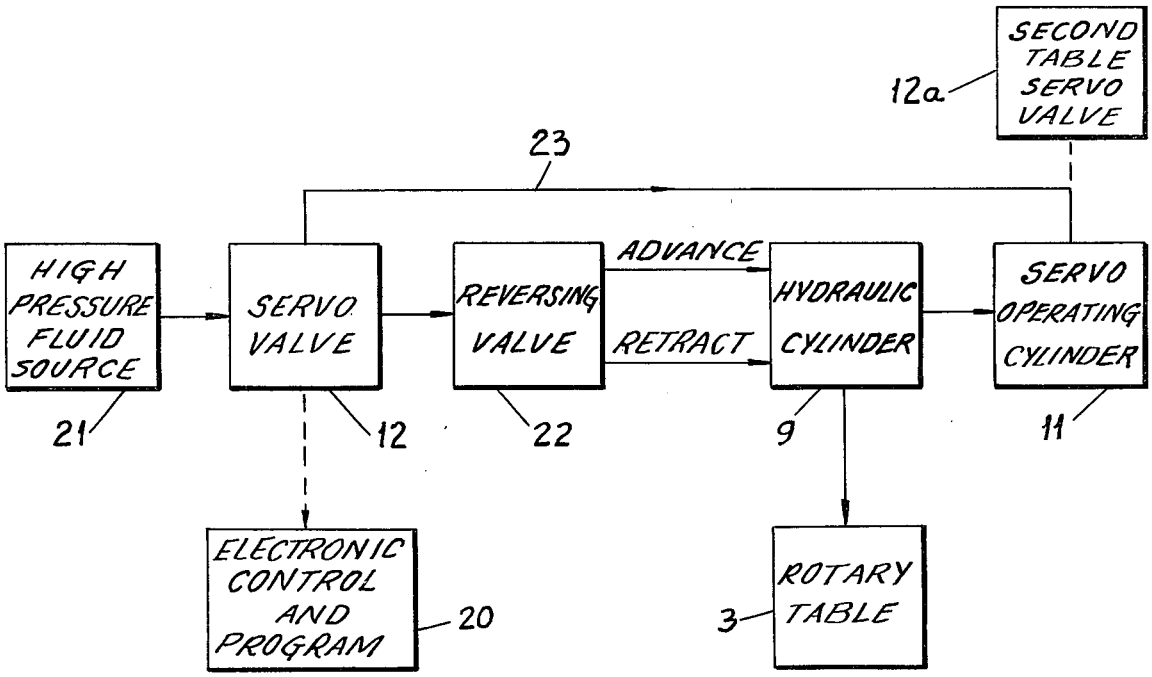
FIG. 3 is a block diagram which schematically illustrates the operation and control of the apparatus of FIGS. 1 and 2.

The control arrangement is generally schematically shown in FIG. 3 where it is seen that a source 21 of high-pressure fluid, such as oil or the like, is connected to the hydraulic clinder 9 through the servo valve 12 and a reversing valve 22. The servo valve 12 can be accurately controlled to control the pressure on hydraulic cylinder 9 as determined by a hydraulic feedback path 23 from the servo operating cylinder 11 and as programmed by the electronic control and program circuitry 20. Reversing valve 22 causes the ram of hydraulic cylinder 9 to either advance or retract in order to rotate the tool holders 8 in one or in an opposite direction.

The hydraulic cylinder 9 then causes rotation of the tool holder 8 as previously described, and further positions a plunger or piston of the servo operating cylinder 11 in order to deliver a signal through conduit 23 which is related to the position and movement of the ram of the hydraulic cylinder 9. At the same time, the hydraulic cylinder 9 causes the rotation of table 3 in order to cause the bending of the workpiece.

The individual bending tables 3 of carriages 2 and **2*a* may be provided with the same control loop, such as that shown in FIG. 3, so that they can be controlled separately and thus bend through respective workpiece elements to a given bending radius within some fixed time. If desired, the entire control loop for the carriage 2 could be used as a control arrangement for the entire assembly in order to simplify the control of the overall unit. Thus, the bending table of carriage 2*a* can be designed to be operated by a follow-up control system derived from the control of carriage 2. This arrangement is schematically illustrated in FIG. 3 by the dotted line connection from the servo operating cylinder 11 to the second servo valve 12*a* of carriage 2*a*.**

As a further feature of the invention, cam members 13 and **13*a* are fixed to rotating tool holders 8 where the cam members 13 and 13*a* bear against cam follower rollers 14 and 14*a*. The tool holder 8 can then move back and forth in a carriage guide, schematically shown by the dotted line 30 in FIG. 2, relative to the carriage 2 and the rails 4, and its cam 13 is normally pressed against the cam follower roller 14 by a pressure member which is placed under pressure by the auxiliary cylinder 15. Thus, as the tool holders 8 rotate and depending upon the draw stress and radii to which their respective workpiece portion is to receive, the cams will cause the axes of shafts 10 of carriages 2 and 2*a* to change according to the shapes of cams 13 and 13*a*. The cylinder 15 will provide a constant force pressing the cam surfaces of cams 13 and 13*a* against their respective rollers 14 and 14*a*.**

Figure 2:
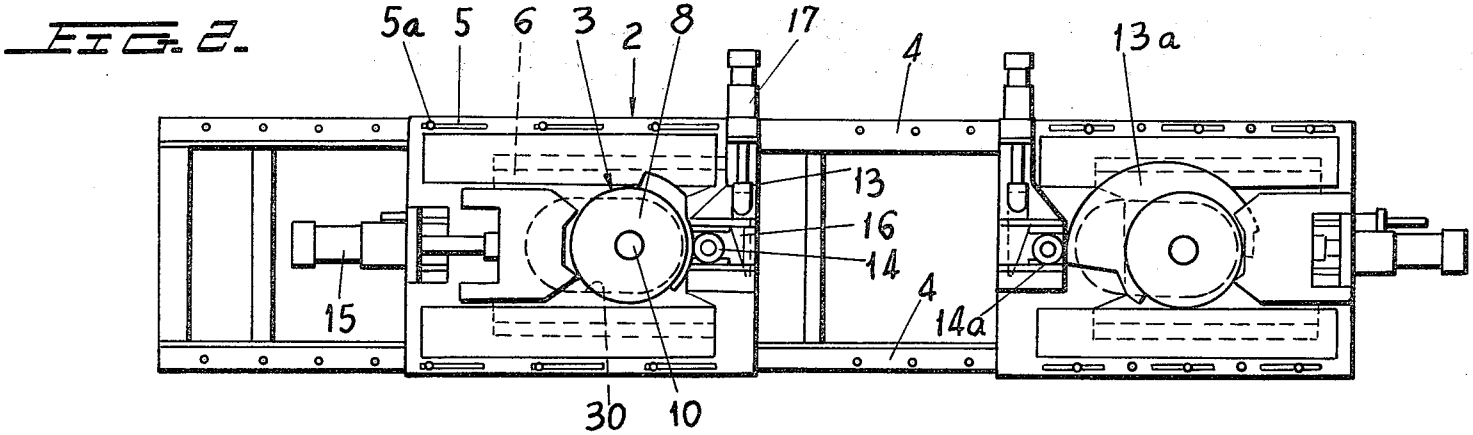
FIG. 2 is a top view of the apparatus of FIG. 1.

FIGS. 1 and 2 further illustrate the use of a well known tensile stress relieving wedge 16 which may be moved upwardly by hydraulic cylinder 17 in order to relieve the stress applied to the workpiece by permitting cam rollers 14 and **14*a*** to move closer to one another under given conditions.

Although there has been described a preferred embodiment of this invention, many variations and modifications will now be apparent to those skilled in the art. Therefore, this invention is to be limited, not by the specific disclosure herein, but only by the appended claims.

The embodiments of the inventor in which an exclusive privilege or property is claimed are defined as follows:

1. Apparatus for draw-bending a workpiece comprising, in combination:

first and second spaced bending tables each rotatable about respective spaced, parallel axes;

tool holder means connected to and rotatable with said first and second spaced bending tables; said tool holder means being connectable to a workpiece to be bent in response to the rotation of said first and second bending tables; the space between said tool holder means of said first and second spaced bending tables being free of intervening mechanism thereby to permit the free suspension of a workpiece between said tool holder means of said first and second bending tables;

operating means connected to said first and second bending tables for rotating said first and second bending tables;

control means connected to said operating means for establishing the angle of rotation of each of said first and second bending table;

said first and second bending tables being rotatable through different respective angles by said operating means;

means connecting said first and second bending tables to one another for rotating said bending tables through different angles of rotation simultaneously during an identical time period.

2. The apparatus of claim 1 wherein said operating means includes first and second hydraulic cylinders having respective output pistons; said output pistons connected to said first and second bending tables respectively.

3. The apparatus of claim 1 which further includes a support frame and first and second spaced carriages adjustably secured to said support frame; said first and second bending tables being movably supported in said first and second carriages respectively.

4. The apparatus of claim 2 wherein said control means includes servo valve means for controlling the pressure applied to said hydraulic cylinders in response to the movement of said output pistons, and electronic control means for controlling and programming the operation of at least the said servo valve associated with said first hydraulic cylinder.

5. The apparatus of claim 2 which further includes a support frame and first and second spaced carriages adjustably secured to said support frame; said first and second bending tables being movably supported in said first and second carriages respectively.

6. The apparatus of claim 4 which further includes a support frame and first and second spaced carriages adjustably secured to said support frame; said first and second bending tables being movably supported in said first and second carriages respectively.

7. The process of draw-bending a workpiece which is clamped to spaced first and second rotatable wortables and which is freely suspended between said first and second rotatable worktables, comprising the steps of applying a rotating torque to said first worktable for rotating said first rotatable worktable during a predetermined time interval at a first rate through a first given angle, corresponding to the radius at which a first portion of said workpiece connected thereto is to be bent, and simultaneously applying a rotating torque to said second worktable for rotating said second rotatable worktable during said time interval at a second rate, different from said first rate, through a second given angle, corresponding to the radius at which a second portion of said workpiece is to be bent, and simultaneously removing said rotating torque from said first and second worktables at the end of said time interval to stop the rotation of said worktables independently of fixed stop means.

* * * * *